United States Patent [19]

de Nora et al.

[11] 4,285,799

[45] Aug. 25, 1981

[54] ELECTRODES FOR ELECTROLYTIC PROCESSES, ESPECIALLY METAL ELECTROWINNING

[75] Inventors: Vittorio de Nora, Nassau, The Bahamas; Antonio Nidola, Milan, Italy; Placido M. Spaziante, Lugano, Switzerland

[73] Assignee: Diamond Shamrock Technologies, S.A., Geneva, Switzerland

[21] Appl. No.: 97,345

[22] PCT Filed: Mar. 27, 1979

[86] PCT No.: PCT/EP79/00020

§ 371 Date: Nov. 28, 1979

§ 102(e) Date: Nov. 26, 1979

[87] PCT Pub. No.: WO79/00840

PCT Pub. Date: Oct. 18, 1979

[30] Foreign Application Priority Data

Mar. 28, 1978 [GB] United Kingdom ..... 12054/78

[51] Int. Cl.[3] ..... C25B 11/08; C25B 11/16; C25B 1/00

[52] U.S. Cl. ..... 204/290 F; 204/1.5; 204/290 R; 204/291

[58] Field of Search ..... 204/290 R, 290 F, 290 K, 204/291

[56] References Cited

U.S. PATENT DOCUMENTS

| | | | |
|---|---|---|---|
| 1,143,828 | 6/1915 | Isherwood | 204/291 |
| 1,296,188 | 3/1919 | Huth | 204/29 X |
| 3,616,302 | 10/1971 | Osawa et al. | 204/40 |
| 3,632,498 | 1/1972 | Beer | 204/290 F |
| 3,647,641 | 3/1972 | Grubb et al. | 204/1 T |
| 3,663,280 | 5/1972 | Lee | 427/126 |
| 3,855,084 | 12/1974 | Feige | 204/38 R |
| 3,878,083 | 4/1975 | de Nora et al. | 204/290 F |
| 4,028,215 | 6/1977 | Lewis et al. | 204/290 F |
| 4,072,586 | 2/1978 | de Nora et al. | 204/105 M |

OTHER PUBLICATIONS

Kokhanov et al., Chem. Abs. vol. 78 Abs. 131300f (1973).

*Primary Examiner*—F. C. Edmundson
*Attorney, Agent, or Firm*—John P. Hazzard

[57] ABSTRACT

An electrode for electrolytic processes such as the recovery of uranium dioxide from seawater comprises an electrically-conductive corrosion-resistant substrate having an electrocatalytic coating which is preferably a mixture of 30 to 80 parts by weight of platinum, 20 to 70 parts by weight (as Mn metal) of $\beta$—$MnO_2$ and 2 to 10 parts by weight (as Sn metal) of tin dioxide.

5 Claims, 2 Drawing Figures faraday efficiency for the $UO_2$ deposition reaction (%)
10
5
0
10 20 30 40 50 60 70 80 90 100
[$\beta MnO_2$] content into [Pt] % as Mn anode potential V(NHE)
2.0
1.8
1.6
1.4
1.2
1.0
$2Cl^- \rightarrow Cl_2 + 2e$
$H_2O \rightarrow 1/2(O_2) + 2H^+ + 2e$
— Pt + $\beta MnO_2$ + $SnO_2$ onto sintered Ti
--- Pt onto sintered Ti
$2H_2O + U^{3+} \rightarrow UO_2 + 4H^+ + e$
10
50
($A/m^2$) curr. density (Log. scale)

ELECTRODES FOR ELECTROLYTIC PROCESSES, ESPECIALLY METAL ELECTROWINNING

TECHNICAL FIELD

The invention relates to electrodes for electrolytic processes, in particular to electrodes having an active surface containing manganese dioxide, and to electrolytic processes using such electrodes, especially as anodes for metal electrowinning.

BACKGROUND ART

Anodes made of manganese oxides have been known for a long time and are disclosed, for instance, in U.S. Pat. Nos. 1,296,188 and 1,143,828. Such anodes have been used in the electrowinning of metals such as zinc, copper and nickel. For various reasons, such as the difficulties met with in forming them, such anodes are not suitable for commercial use, however. Another proposed electrode is described in U.S. Pat. No. 3,855,084, wherein titanium particles are cemented together with thermally-deposited manganese dioxide and a second or outer coating of electrodeposited manganese dioxide is provided thereon.

U.S. Pat. No. 3,616,302 describes an electrowinning anode, comprising a sandblasted titanium substrate coated with a thin intermediate layer of platinum, palladium or rhodium or their alloys, on which a relatively thick layer of manganese dioxide is electroplated.

U.S. Pat. No. 4,028,215 discloses an electrode which comprises a valve metal substrate, an intermediate semiconductive layer of tin and antimony oxides and a top coating of manganese dioxide.

More recently, U.S. Pat. No. 4,072,586 proposed an electrode having a corrosion-resistant substrate coated with $\beta$-manganese dioxide, chemideposited by thermal decomposition of an alcoholic solution of manganese nitrate, and activated by $\beta$-ray irradiation or by the addition of up to 5% by weight of at least one metal from groups IB, IIB, IVA, VA, VB, VIB, VIIB and VIII of the Periodic Table, excluding the platinum group metals, gold and silver. The corrosion-resistant substrate was optionally provided with a thin porous intermediate coating, such as a valve metal or a platinum group metal or oxide thereof, and the activated manganese dioxide optionally contained up to 20% by weight of silicon dioxide, $\beta$-lead dioxide or tin dioxide as stabilizer.

DISCLOSURE OF INVENTION

An object of the invention is to provide an improved electrode, having a coating of manganese dioxide which selectively favours oxygen evolution, the electrode being particularly useful for electrowinning metals from dilute solutions.

According to a main aspect of the invention, an electrode for electrolytic processes comprises an electrically-conductive corrosion-resistant substrate having an electrocatalytic coating, characterized in that the coating contains a mixture of at least one platinum group metal and manganese dioxide dispersed in one another throughout the coating, in a ratio of from 8:2 to 3:7 by weight, of the platinum group metal(s) to the manganese metal of the manganese dioxide. Preferably, the coating contains platinum in a ratio of from 7:3 to 4:6 by weight.

The platinum-group metal/manganese dioxide coating preferably also contains, as a stabilizer, titanium oxide, silicon dioxide, $\beta$-lead dioxide and/or tin dioxide, most preferably tin dioxide. The presence of a stabilizer is especially useful when the manganese content exceeds the platinum group metal content, in order to prevent corrosion of the coating during electrolysis. Additionally, the coating may include a filler, e.g. particles or fibres of an inert material such as silica or alumina, particles of titanium or, advantageously, zirconium silicate. Furthermore, depending on the use to which the electrode is to be put, the mixed coating of platinum group metal(s) and manganese dioxide may also contain, as dopant, up to about 5% by weight as metal of the manganese dioxide, at least one additional metal selected from groups IB, IIB, IVA, VA, VB, VIB and VIIB of the periodic table and iron, cobalt and nickel. Usually such stabilizers, fillers and dopants do not account for more than 70% of the total weight of the coating, usually far less. In the case of tin dioxide, the preferred amount is about 5% to 10% by weight of tin to the total weight of the platinum group metal(s) plus the manganese metal of the manganese dioxide.

The platinum group metals are ruthenium, rhodium, palladium, osmium, iridium and platinum. Platinum metal is preferred and is mentioned hereafter by way of example. However, it is to be understood that alloys such as platinum-rhodium and platinum-palladium can also be used. Also, in some instances, it may be advantageous to alloy the platinum group metal(s) with one or more non-platinum group metals, for example an alloy or an intermetallic compound with one of the valve metals, i.e. titanium, zirconium, hafnium, vanadium, niobium and tantalum, or with another transition metal, for example a metal such as tungsten, manganese or cobalt.

The substrate may consist of any of the aforementioned valve metals or alloys thereof, porous sintered titanium being preferred. However, other electrically-conductive and corrosion-resistant substrates may be used, such as expanded graphite.

The platinum group metal(s) and manganese dioxide with possible additional components, such as tin dioxide, may be co-deposited chemically from solutions of appropriate salts which are painted, sprayed or otherwise applied on the substrate and then subjected to heat treatment, this process being repeated until a sufficiently thick layer has been built up.

Alternatively, thin layers of different components (e.g. alternate platinum layers and layers of mixed $\beta$-manganese dioxide and tin dioxide) can be built up in such a way that the components are effectively mixed and dispersed in one another throughout the coating, possibly with diffusion between the layers, in contrast to the cited prior art coatings in which the manganese dioxide was applied as a separate top layer.

In all instances, the manganese dioxide is preferably in the $\beta$ form, being chemi-deposited by thermal decomposition of a solution of manganese nitrate.

The platinum-group metal/manganese dioxide layer may be applied directly to the substrate or to an intermediate layer, e.g. of co-deposited tin and antimony oxides or tin and bismuth oxides or to intermediate layers consisting of one or more platinum group metals or their oxides, mixtures or mixed crystals of platinum group metals and valve metal oxides, intermetallics of platinum group metals and non-platinum group metals, and so forth.

In a preferred embodiment, the coating comprises 30 to 80 parts by weight of platinum, 20 to 70 parts by weight (as Mn metal) of $\beta$-manganese dioxide and 2 to 10 parts by weight (as Sn metal) of tin dioxide. This embodiment of an electrode of the invention, when used as anode for metalwinning from dilute solutions, has been found to have selective properties favouring oxygen evolution and the deposition of certain metal oxides, e.g. the anodic deposition of $UO_2$ from seawater. The platinum metal plays three roles: as an electronic conductor; as oxygen evolution catalyst (the wanted reaction); and as chlorine evolution poison (the unwanted reaction). Not only is $\beta$-manganese dioxide isomorphous with $UO_2$, but also it acts as a catalyst for $UO_2$ deposition. Finally, the tin dioxide, in addition to stabilizing the $\beta$-manganese dioxide, acts as a source of active oxygen ($H_2O_2$).

Another aspect of the invention is a method of electro-recovering metals, especially strategic metals such as uranium, yttrium and ytterbium, or their oxides, e.g. from dilute saline waters such as seawater, which comprises using as anode an electrode according to the invention, as defined above. This method is preferably carried out with deposition of the metal oxide in oxygen-evolving conditions.

1 BEST MODES FOR CARRYING OUT THE INVENTION

The following Examples are given to illustrate the invention:

EXAMPLE I

Figure 1:
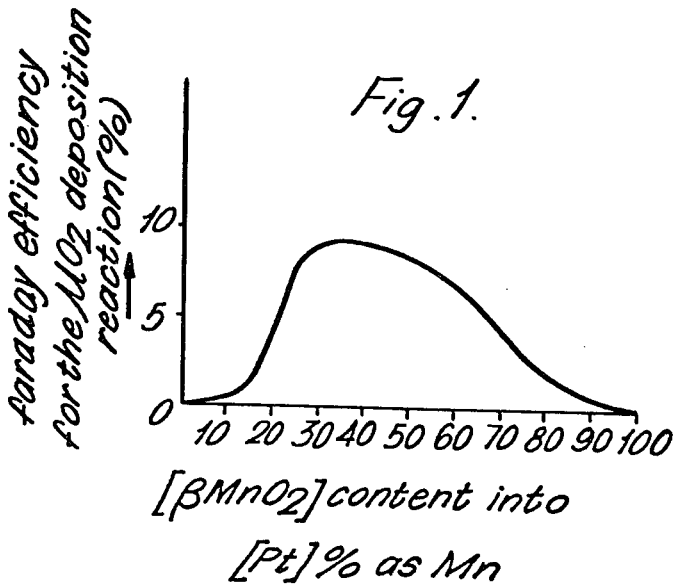
FIG. 1 is a graph showing faraday efficiency of $UO_2$ deposition as ordinate plotted against the $\beta$-$MnO_2$ content by weight of Mn to the total weight of Mn+Pt group metal as abscissa, obtained by use of the electrode described in detail in Example I below.

Mixed coatings of platinum metal and $\beta$—$MnO_2$ were applied to expanded graphite anode bases by chemideposition from a solution containing platinum and manganese nitrate in isopropyl alcohol. After each application of the coating solution by brush, the anode bases were heated at 300° to 320° C. in an oven with air circulation, for about 10 minutes, and the procedure was repeated ten times for each anode base. The coated electrodes were then used for the recovery of $UO_2$ from a dilute saline solution containing 30g/l NaCl and 100 ppm of uranium acetate. The electrolyte was held at 20° C. and was stirred by ultrasounds. The faraday efficiency of the $UO_2$ deposition reaction was measured. FIG. 1 shows a graph of this faraday efficiency as a function of the $\beta$—$MnO_2$ content by weight of manganese metal to the total weight of manganese plus platinum metals in the coating. From this graph, it can be seen that there is an optimum value of the $\beta$—$MnO_2$ content of about 30% to 40% (as Mn metal) corresponding to the maximum $UO_2$ faraday efficiency. For Mn metal contents above 40%, corrosion and dissolution of the $\beta$—$MnO_2$ were observed, being detected by atomic adsorption analyses on the used electrolyte.

EXAMPLE II

Expanded graphite anode bases were coated as in Example I, except that the coating solution additionally contained tin nitrate. The finished coatings contained $\beta$—$MnO_2$ (50% by weight as Mn metal), Pt (40%-50% by weight as metal) and $SnO_2$ (0% -10% by weight as Sn metal). These anodes were used, under the same conditions as Example I, for $UO_2$ recovery. An optimum faraday efficiency for $UO_2$ deposition was achieved with an Sn content of from about 3% to 6%. No corrosion or dissolution of the $MnO_2$ was observed.

EXAMPLE III

Figure 2:
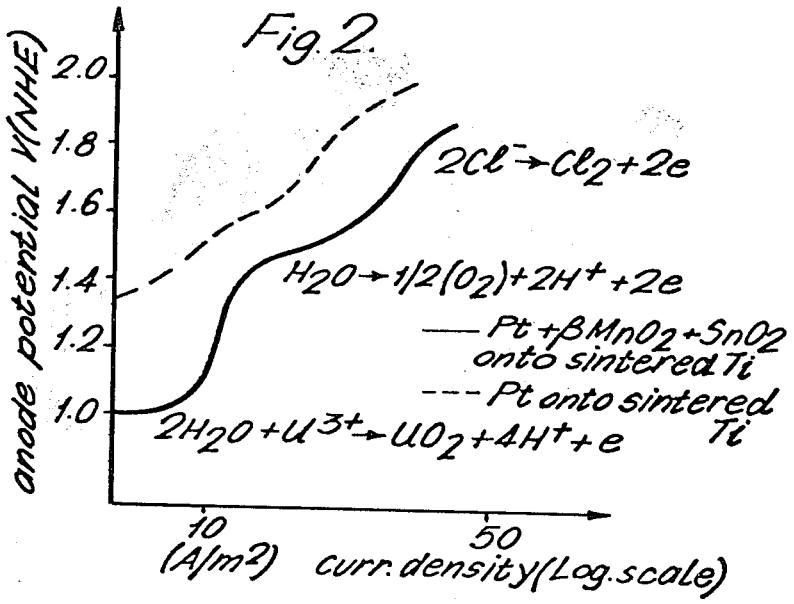
FIG. 2 is a graph showing anode potential as ordinate plotted against current density as abscissa, obtained using the electrodes described in detail in Example III below.

Examples I and II were repeated using porous sintered titanium anode bases which, prior to coating, were subjected to sandblasting with steel grit followed by etching in boiling HCl for about 10 minutes. These anodes gave similar results for $UO_2$ deposition under the same conditions as Examples I and II. FIG. 2 is a potentiostatic curve of such a sintered titanium anode coated with a chemi-deposited coating containing 45% by weight Pt, 50% by weight $\beta$—$MnO_2$ (as Mn metal) and 5% by weight $SnO_2$ (as Sn metal). The corresponding curve for a platinum-coated sintered titanium anode is shown as a dashed line. No $UO_2$ deposition was obtained on the platinum-coated anode, which gave simultaneous chlorine and oxygen evolution at mixed potential. For the Pt—$\beta$—$MnO_2$—$SnO_2$ coated anode, $UO_2$ deposition started at a potential of about 1.0 V(NHE), while oxygen evolution took place at 1.4V (NHE) and chlorine evolution at 1.7 V(NHE). Under chlorine evolving conditions, the deposited $UO_2$ was found to dissolve rapidly, while no dissolution of the $UO_2$ deposit took place under oxygen evolving conditions. Further, the $UO_2$ deposition rate was observed to be greater at the oxygen evolution potential than at lower potential. This graph may be explained by the following reactions:

(i) direct electrochemical oxidation of low valent uranium species, e.g.

$$U^{III}O^{+} + H_2O \longrightarrow [U^{IV}O_2]\downarrow + 2H^{+} + e$$

(ii) catalytic chemical oxidation of low valent uranium species by atomic oxidation or peroxide compounds:

$$H_2O \longrightarrow \underset{\text{active oxygen}}{O} + 2H^{+} + 2e$$

$$\underset{\text{active oxygen}}{2O} + U^{III} \longrightarrow [UO_2]\downarrow$$

Reaction (ii) is favoured by the presence of $SnO_2$, which acts as a source of active oxygen by complexing $H_2O_2$ in addition to stabilizing the $MnO_2$ phase.

We claim:

1. An electrode for electrolytic processes, comprising an electrically-conductive corrosion-resistant substrate having an electrocatalytic coating, characterized in that the coating contains a mixture of at least one platinum group metal and manganese dioxide dispersed in one another throughout the coating in a ratio of from 8:2 to 3:7 by weight of the platinum group metal(s) to the manganese metal of the manganese dioxide.

2. The electrode of claim 1, characterized in that the coating contains platinum in a ratio of 7:3 to 4:6 by weight of the platinum to the manganese metal of the manganese dioxide.

3. The electrode of claim 1 or 2, characterized in that the coating further contains silicon dioxide, β-lead dioxide and/or tin dioxide as stabilizer.

4. The electrode of claim 1, characterised in that the coating contains 30 to 80 parts by weight of platinum, 20 to 70 parts by weight (as Mn metal) of β-manganese dioxide and 2 to 10 parts by weight (as Sn metal) of tin dioxide.

5. The electrode of claim 1, 2, or 4, characterized in that the electrocatalytic coating containing the platinum group metal(s) and manganese dioxide is applied to an intermediate conductive layer carried on the substrate.

* * * * *